US009404318B2

(12) United States Patent
Bowley et al.

(10) Patent No.: US 9,404,318 B2
(45) Date of Patent: Aug. 2, 2016

(54) TOP DRIVE COUNTER MOMENT SYSTEM

(71) Applicant: Tesco Corporation, Houston, TX (US)

(72) Inventors: Ryan Thomas Bowley, Calgary (CA); Edgar Fernando Yajure, Calgary (CA)

(73) Assignee: Tesco Corporation, Houston, TX (US)

( * ) Notice: Subject to any disclaimer, the term of this patent is extended or adjusted under 35 U.S.C. 154(b) by 407 days.

(21) Appl. No.: 13/928,173

(22) Filed: Jun. 26, 2013

(65) Prior Publication Data

US 2014/0000912 A1 Jan. 2, 2014

Related U.S. Application Data

(60) Provisional application No. 61/666,529, filed on Jun. 29, 2012.

(51) Int. Cl.

| | |
|---|---|
| ***E21B 19/02*** | (2006.01) |
| ***E21B 19/00*** | (2006.01) |
| ***E21B 3/02*** | (2006.01) |
| ***E21B 19/08*** | (2006.01) |

(52) U.S. Cl.
CPC . *E21B 19/00* (2013.01); *E21B 3/02* (2013.01); *E21B 19/02* (2013.01); *E21B 19/08* (2013.01)

(58) Field of Classification Search
CPC ..... E21B 19/02; E21B 19/06; E21B 19/08; E21B 19/087; B66C 13/06; B66C 13/04
USPC ..... 294/102.2, 86.13
See application file for complete search history.

(56) References Cited

U.S. PATENT DOCUMENTS

| | | | | |
|---|---|---|---|---|
| 2,313,243 | A * | 3/1943 | Johnson | B66C 1/00 254/277 |
| 3,159,286 | A * | 12/1964 | Freeman, Sr. | E21B 19/155 414/22.61 |
| 5,433,279 | A | 7/1995 | Tessari et al. | |
| 2005/0269104 | A1 | 12/2005 | Folk et al. | |
| 2010/0065336 | A1 | 3/2010 | Wells et al. | |
| 2012/0160517 | A1 | 6/2012 | Bouligny et al. | |

OTHER PUBLICATIONS

International Search Report and Written Opinion for PCT Application No. PCT/US2013/048290 mailed Sep. 4, 2014.

* cited by examiner

*Primary Examiner* — Cathleen Hutchins
(74) *Attorney, Agent, or Firm* — Fletcher Yoder, P.C.

(57) ABSTRACT

Present embodiments are directed to a top drive system comprising a hoisting assembly having an upper link, a lower link, and a first joint coupling the upper link and the lower link. The top drive system also includes a main body coupled to the hoisting assembly by a second joint, wherein the hoisting assembly is configured to support the main body, and the main body is configured to support a tubular. Further, the top drive system includes a frame coupled to the main body and a counter moment system configured to apply a force on the first joint to create a bending moment about the second joint.

16 Claims, 3 Drawing Sheets

TOP DRIVE COUNTER MOMENT SYSTEM

CROSS-REFERENCE TO RELATED APPLICATIONS

This application claims priority from and the benefit of U.S. Provisional Application Ser. No. 61/666,529, entitled "Top Drive Counter Moment System," filed Jun. 29, 2012, which is hereby incorporated by reference in its entirety.

BACKGROUND

Embodiments of the present disclosure relate generally to the field of drilling and processing of wells. More particularly, present embodiments relate to a system and method for stabilizing a top drive during a drilling process, a casing process, or another type of well processing operation.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

BRIEF DESCRIPTION

In accordance with one aspect of the disclosure, a top drive system includes a hoisting assembly; an upper link of the housing assembly, a lower link of the housing assembly, and a first joint coupling the upper link and the lower link. The top drive system also includes a main body coupled to the hoisting assembly by a second joint, wherein the hoisting assembly is configured to support the main body, and the main body is configured to support a tubular. Further, the top drive system includes a frame coupled to the main body and a counter moment system configured to apply a force on the first joint to create a bending moment about the second joint.

Another embodiment includes a top drive system including a hoisting assembly, a main body coupled to the hoisting assembly by a first joint, wherein the hoisting assembly is configured to support the main body, and the main body is configured to support a tubular, a frame coupled to the main body, a torque track system comprising a torque bushing, and a counter moment system configured to apply a force on a second joint of the hoisting assembly to create a bending moment about the second joint.

In accordance with another aspect of the disclosure, a method includes coupling a main body of a top drive system to a hoisting assembly with a first joint, suspending the main body of the top drive system with the hoisting assembly, and applying a force to a second joint of the hoisting assembly to create a bending moment about the first joint.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

It is now recognized that top drive systems may have a center of gravity that is offset from a hanging load of the top drive system. Specifically, it is now recognized that the offset center of gravity may cause an overturning moment acting on the top drive system, which may result in excessive or premature wear on top drive system components or other components coupled to the top drive system. Accordingly, there is a presently recognized need to reduce or counterbalance overturning moments acting on a top drive system and related components.

Present embodiments provide a counter moment system for a top drive system. Specifically, the counter moment system is configured to create a force acting on a link or joint of a hoisting system. As the counter moment system creates the force acting on the link or joint of the hoisting system, a reaction force acting on the link or joint produces a counter moment on the top drive system. In certain embodiments, the counter moment counterbalances a overturning moment acting on the top drive caused by an offset center of gravity of the top drive system. In this manner, forces caused by the overturning moment and acting on other components of the top drive system, such as a torque bushing of a torque track system, may be reduced, thereby reducing premature and excessive wear on the torque bushing. Thus, present embodiments improve top drive performance and prolong the useful life of a top drive.

Figure 1:
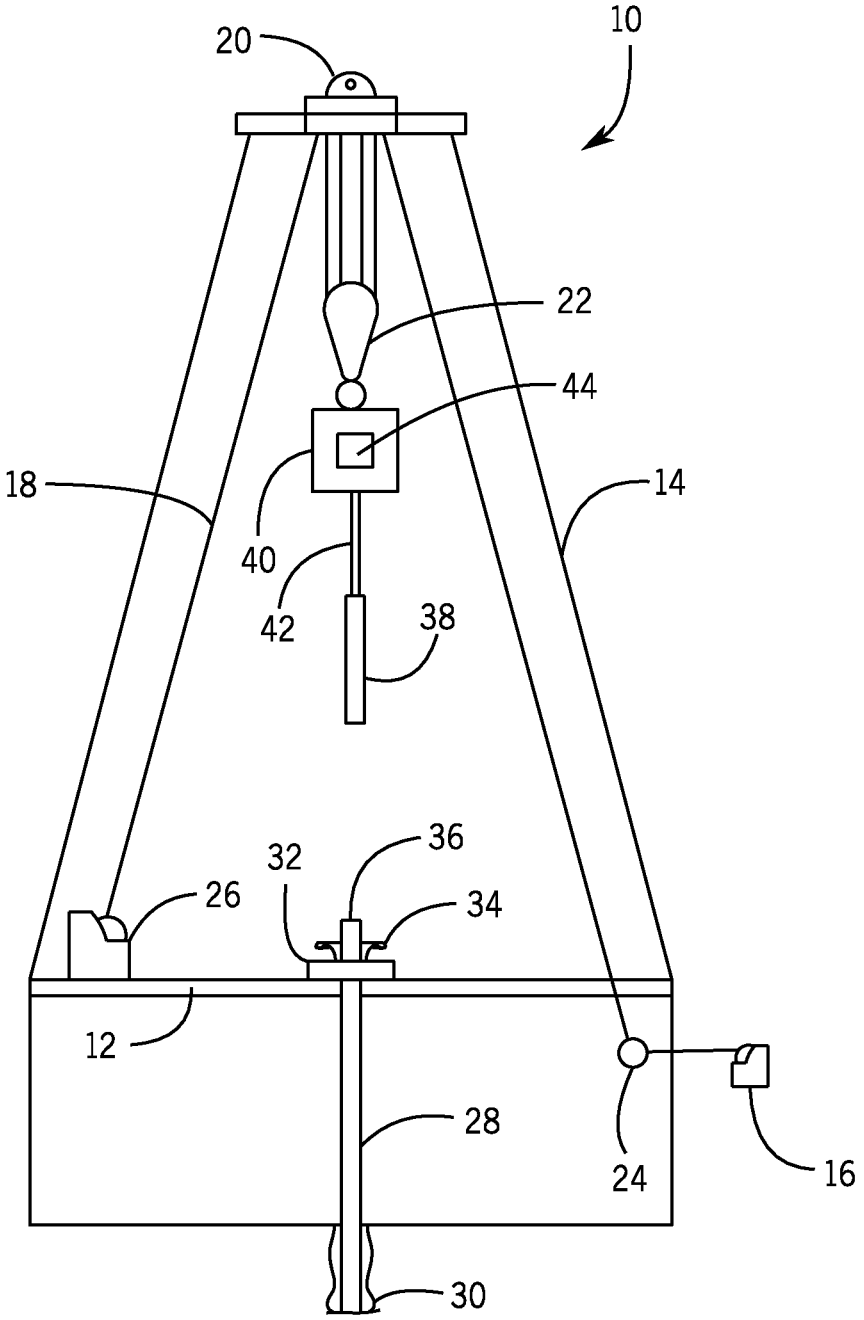
FIG. 1 is a schematic of a well being drilled, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. A top drive 40, hoisted by the traveling block 22, positions the tubular 38 above the wellbore before coupling with the tubular 38. The top drive 40, once coupled with the tubular 38, may then lower the coupled tubular 38 toward the stump 36 and rotate the tubular 38 such that it connects with the stump 36 and becomes part of the drill string 28. Specifically, the top drive 40 includes a quill 42 used to turn the tubular 38 or other drilling equipment.

FIG. 1 further illustrates the top drive 40 with a counter moment system 44. As discussed below, the center of gravity of the top drive 40 may not be centered above the quill 42 and/or tubular 38 (e.g., a hanging load of the top drive 40). Consequently, the top drive 40 may experience a moment or rotating force (e.g., an overturning moment), which is counterbalanced by other features. For example, a torque track or dolly system of the top drive 40 may function to counterbalance the moment. In other words, the torque track or dolly system (e.g., a torque bushing of the torque track) may experience forces that counteract the overturning moment created be the unbalanced center of gravity of the top drive 40. As a result, components of the torque track or dolly system (e.g., a torque bushing) may experience excessive and/or premature wear. As discussed in detail below, the counter moment system 44 of the top drive 40 is configured to produce a counter moment that counteracts the overturning moment created by the unbalanced center of gravity of the top drive 40. For example, a force may be applied to one or more components of the top drive 40 that creates a reverse bending moment (e.g., a counter moment) that partially or completely counter balances the overturning moment acting on the top drive 40. In this manner, the forces acting on certain features (e.g., the torque track or dolly system) due to the overturning moment may be reduced, thereby reducing excessive and premature wear on one or more of the features.

It should be noted that the illustration of FIG. 1 is intentionally simplified to focus on the top drive 40 with the counter moment system 44 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
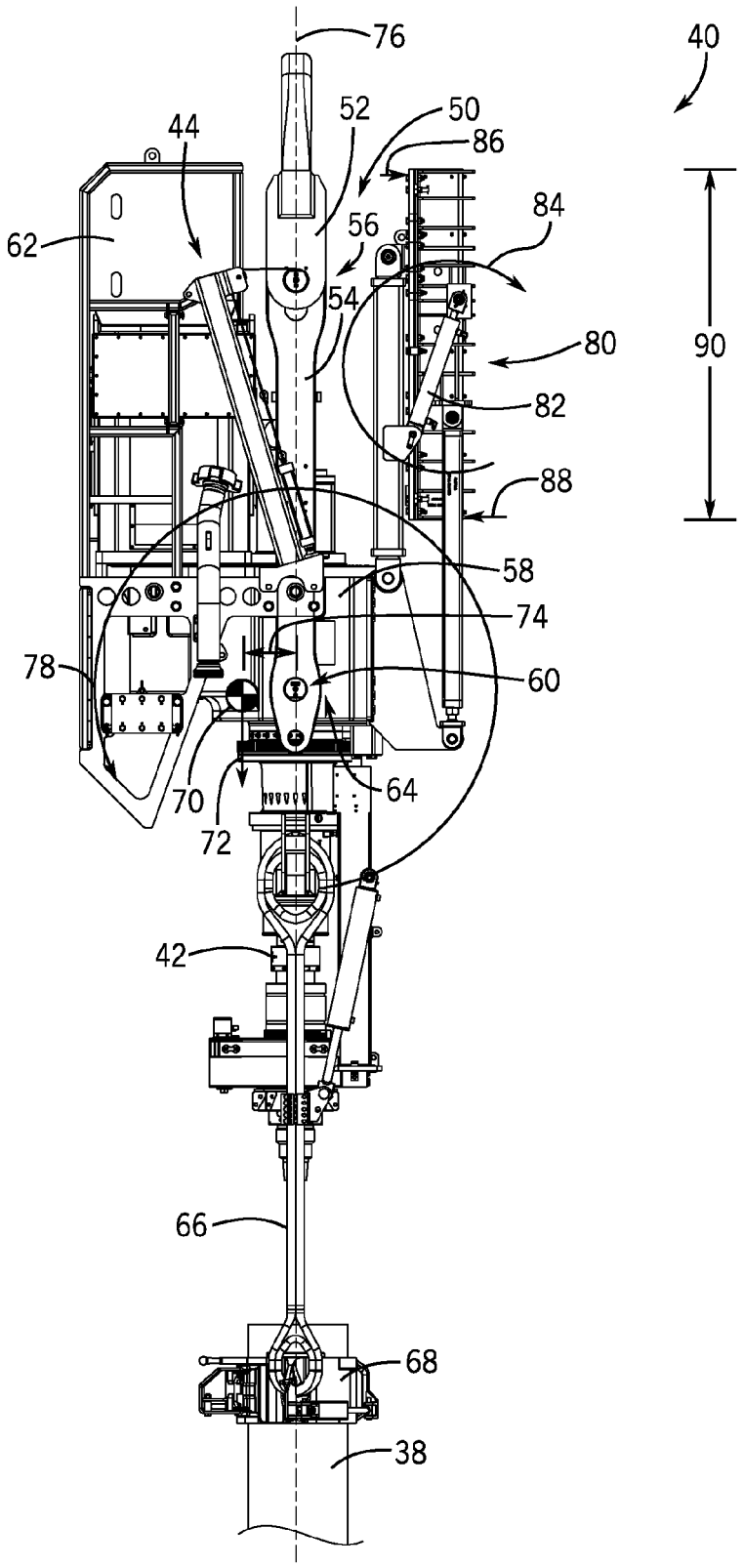
FIG. 2 is a side view of a top drive having a counter moment system, in accordance with present techniques.

FIG. 2 is a side view of an embodiment of the top drive 40 having the counter moment system 44. In the illustrated embodiment, the top drive 40 includes a hoisting assembly 50, which includes an upper link 52 and a lower link 54, which are coupled to one another by a joint 56 (e.g., a pin joint). The lower link 54 is also coupled to a main body 58 of the top drive 40 with a joint 60 (e.g., a pin joint). The main body 58 of the top drive 40 is further coupled to other components of the top drive 40. For example, the main body 58 is coupled to a frame 62 of the top drive 40 and the quill 42 of the top drive 40. The main body 58 further includes a torque and drive system 64, which operates to drive rotation of the tubular 38 supported by the top drive 40 by applying a torque to the quill 42. In the illustrated embodiment, the tubular 38 is coupled to the quill 42 by link arms 66 and an elevator assembly 68.

As mentioned above, the top drive 40 has a center of gravity 70 that is not centered above the quill 42 and/or the tubular 38 supported by the top drive 40. That is, the center of gravity 70 (e.g., gravitational force 72 of the top drive 40) is offset a distance 74 from an axis 76 of the hanging load (i.e., the quill 42 and/or the tubular 38) of the top drive 40. As a result, the top drive 40 experiences an overturning moment 78 about the joint 60. As will be appreciated, the overturning moment 78 is equal to the gravitational force 72 times the distance 74 that the center of gravity 70 is offset from the axis 76 of the hanging load. It should be noted that the size of the arrow representing the overturning moment 78 does not reflect the magnitude of the overturning moment 78.

In the illustrated embodiment, the top drive 40 includes a torque track system 80 having a torque bushing 82. As mentioned above, the overturning moment 78 acting on the top drive 40 may be counterbalanced or counteracted by the torque bushing 82 of the torque track system 80, which may cause excessive or premature wear and/or degradation in the torque bushing 82 and or other components of the torque track system 80. For example, the overturning moment 78 acting on the top drive 40 may cause a reactive moment 84 to act on the torque bushing 82. More specifically, as the overturning moment 78 acts on the top drive 40, the torque track system 80 may experience resultant forces 86 and 88, which are separated by a length 90 of the torque track system 80 and which create the reactive moment 84 acting on the torque bushing 82. To reduce the forces (e.g., the reactive moment 84) acting on the torque bushing 82 resulting from the overturning moment 78, the top drive 40 includes the counter moment system 44, which operates in the manner described below.

By way of example, in one embodiment, the gravitational force 72 of the top drive 40 may be approximately 40,000 pounds, and the distance 74 that the center of gravity 70 is offset from the axis 76 of the hanging load of the top drive 40 may be approximately 0.5 feet. As a result, the overturning moment 78 acting on the top drive 40 may be approximately 20,000 foot-pounds of torque. As mentioned above, the torque bushing 82 counterbalances or counteracts the overturning moment 78. That is, the reactive moment 84 acting on the torque bushing 82, which may be approximately equal to the overturning moment 78, counterbalances or counteracts the overturning moment 78. Therefore, in the present example, the reactive moment 84 may be approximately 20,000 foot-pounds acting on the torque bushing 82. Moreover, when the reactive moment 84 is approximately 20,000 foot-pounds, the reactive forces 86 and 88 may be equal to approximately 3,333 pounds of force when the length 90 of the torque track system 80 is approximately 6 feet.

Figure 3:
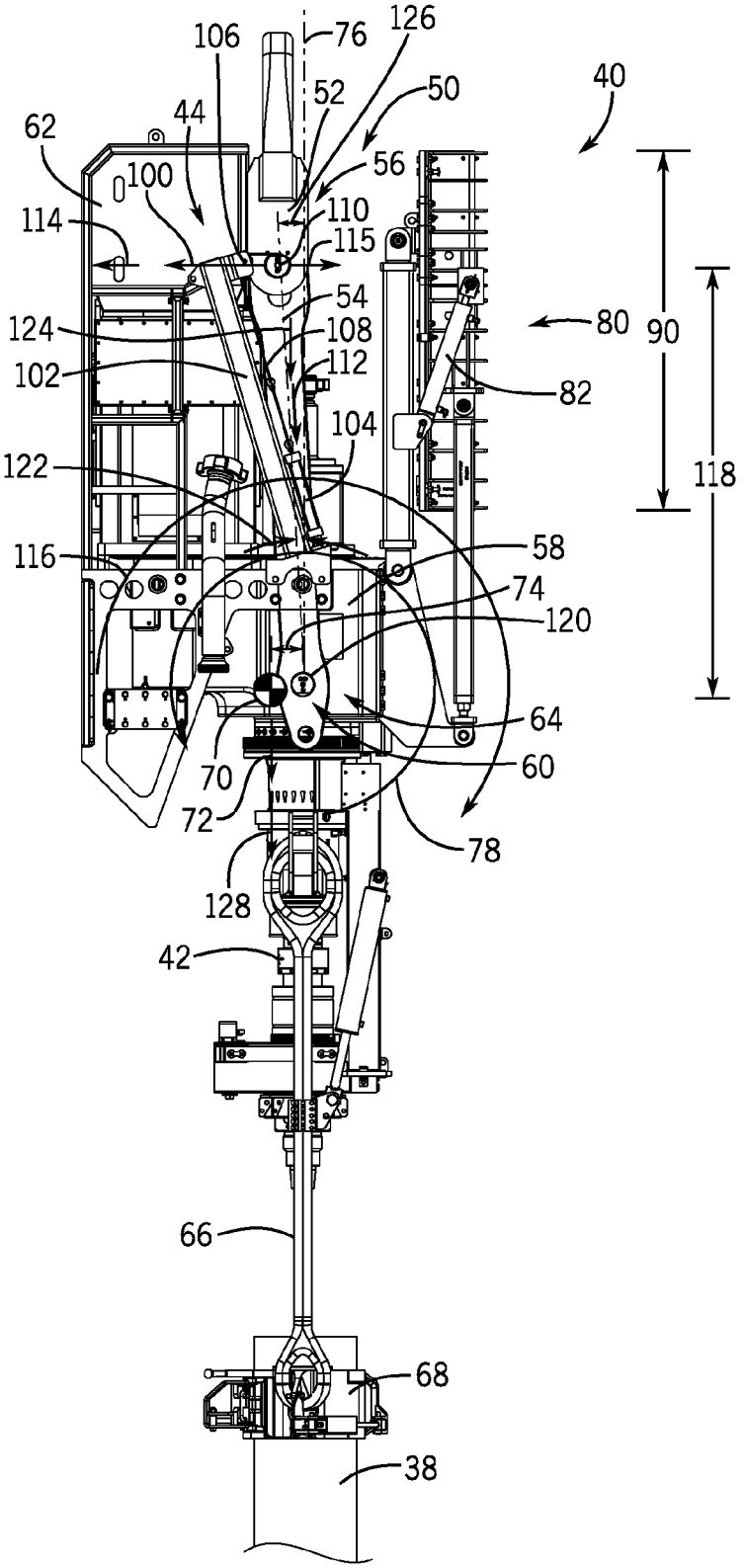
FIG. 3 is a side view of a top drive having a counter moment system, in accordance with present techniques.

FIG. 3 is a side view of an embodiment of the top drive 40 having the counter moment system 44, illustrating the counter moment system 44 in operation. The illustrated embodiment includes similar elements and element numbers as the embodiment shown in FIG. 2.

As mentioned above, the counter moment system 44 is configured to apply a force on components of the top drive 40 to produce a counter moment that reverses or counterbalances the overturning moment 78 created due to the offset center of gravity 70, thereby reducing the forces acting on the torque bushing 82. More specifically, the counter moment system 44 is configured to apply a force, represented by arrow 100, on the joint 56 coupling the upper link 52 and the lower link 54 of the hoisting assembly 50. The force 100 may be applied to the joint 56 in a variety of manners. In the illustrated embodiment, the counter moment system 44 includes a bracket 102 that is coupled to the frame 62 of the top drive 40. For example, the bracket 102 may be fixedly attached to the frame 62. In other words, the bracket 102 may not rotate or pivot relative to the frame 62. Additionally, the bracket 102 is coupled to and supports a hydraulic cylinder 104 and a pulley 106. As shown, a cable 108 is coupled to the hydraulic cylinder 104, extends along the bracket 102, is routed around the pulley 106, and is coupled to a pin 110 of the joint 56.

In operation, the hydraulic cylinder 104 compresses, thereby pulling or drawing the cable 108 in a direction 112. In certain embodiments, the compression and/or operation of the hydraulic cylinder 104 may be controlled by a controlled pressure circuit. Additionally, the hydraulic cylinder 104 may be configured to compress and thereby pull the cable 108 with a constant force. Furthermore, the amount of constant force with which the hydraulic cylinder 104 compresses may vary depending on various factors. For example, the force of the hydraulic cylinder 104 compression may vary depending on the length of the bracket 102, the weight of the top drive 40, the amount of hanging load supported by the top drive 40, and so forth. As the hydraulic cylinder 104 is compressed and the cable 108 is pulled, the force of the cable 108, which is redirected by the pulley 106, pulls the pin 110 and the joint 56 such that they are translated in a direction 114. In other words, the force 100 acting on the pin 110 and the joint 56 is created by the cable 108 that is being pulled by the hydraulic cylinder 104 as its compresses. As the pin 110 and the joint 56 are pulled in the direction 114, the lower link 54 is rotated over the center of gravity 70 of the top drive 40.

Additionally, a reaction force 115 acts on the pin 110 and the joint 56 as the counter moment system 44 applies the force 100 to the pin 110 and joint 56. As will be appreciated by those skilled in the art, the reaction force 115 acting on the pin 110 and the joint 56 produces a counter moment 116 acting on the top drive 40. More specifically, the counter moment 116 is equal to the reaction force 115 times a distance 118 from the pin 110 of the joint 56 to a pin 120 of the joint 60. As shown, the counter moment 116 counterbalances or counteracts the overturning moment 78. As similarly noted above, the size of the arrow representing the counter moment 116, as well as the relative sizes of the arrows representing the overturning moment 78 and the counter moment 116 are not representative of the respective magnitudes of the moments 78 and 116. In certain embodiments, the operation of the hydraulic cylinder 104 may be regulated such that the magnitude of the force 100 (and therefore a resultant force 114) results in the counter moment 116 being equal and opposite to the overturning moment 78 acting on the top drive 40. In this manner, the forces acting on the torque bushing 82 caused by the overturning moment 78 (e.g., the reactive moment 84) may be reduced, thereby reducing premature or excessive wear and degradation on the torque bushing 82.

In other embodiments of the counter moment system 44, other methods or components may be used to produce the force 100 acting on the pin 110 and the joint 56. For example, instead of the hydraulic cylinder 104, the counter moment system 44 may include a spring mechanism (e.g., a preloaded spring mechanism), magnetic mechanism, electrical mechanism, and so forth. Alternatively, the counter moment system 44 may include a counter weight (e.g., a hanging mass and pulley system) to have a gravity-based counter moment system 44. In other embodiments, the counter moment system 44 may include any other device or mechanism capable of applying a linear force (e.g., in the direction 114) on the pin 110 and the joint 56.

By way of example, in one embodiment, the gravitational force 72 of the top drive 40 may be approximately 40,000 pounds, and the distance 74 that the center of gravity 70 is offset from the axis 76 of the hanging load of the top drive 40 may be approximately 0.5 feet. As such, the overturning moment 78 is approximately 20,000 foot-pounds of torque. As discussed in detail above, to provide the counter moment 116, the force 100 is applied to the joint 56. Specifically, the force 100 may be equal to the amount of the overturning moment 78 divided by the distance 118 from the pin 110 of the joint 56 to the pin 120 of the joint 60. In the present example, if the distance 118 is approximately 7 feet, then the force 100 applied to the pin 110 may be equal to approximately 2,857 pounds. As a result, the lower link 54 may be biased at an angle 122 relative to the axis 76 of the hanging load (i.e., the quill 42 and/or the tubular 38) of the top drive 40. In the present example, the angle 122 may be approximately equal to the arctangent of (2,587/40,000), or approximately 4.08 degrees. As a result, a force 124 acting on the lower link 54 may be approximately equal to (1/cosine (4.08)*40,000), or 40101 pounds. Furthermore, in the present example, a distance 126 that the pin 110 is offset from the axis 76 when the force 100 is applied may be approximately equal to sin(4.08)*7 feet, or approximately 0.5 feet.

Continuing with the present example, if the top drive 40 were loaded with 40,000 pounds of tubular 38, then a total force 128 acting on the top drive 40 would equal approximately 40,000 pounds of tubular 38 plus the 40,000 pound weight of the top drive 40 (e.g., gravitational force 72), or 80,000 pounds. Using similar calculations discussed above, if the force 100 applied to the pin 110 to counter act the overturning moment 78 remained at 2,857 pounds, then the center of gravity 72 of the top drive 40 would shift toward the axis 76 by 0.25 feet (i.e., arc tangent of (2,857/80,000), or approximately 0.25 feet).

As discussed in detail above, embodiments of the present disclosure are directed towards a counter moment system 44 for the top drive 40. Specifically, the counter moment system 44 is configured to produce a force (e.g., the force 100) acting on the pin 110 and the joint 56 coupling the upper and lower links 50 and 52. As the counter moment system 44 creates the force 100 acting on the pin 110 and the joint 56, the reaction force 115 acting on the pin 110 and the joint 56 produces the counter moment 116. As discussed above, the counter moment 116 counterbalances the overturning moment 78 acting on the top drive 40 caused by the offset center of gravity 70 of the top drive 40. In this manner, forces (e.g., reaction moment 84) resulting from the overturning moment 78 and acting on the torque bushing 82 of the torque track system 80 may be reduced, thereby reducing premature and excessive wear on the torque bushing 82.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A top drive system, comprising:
- a hoisting assembly;
- an upper link of the hoisting assembly;
- a lower link of the hoisting assembly;
- a first joint coupling the upper link and the lower link;
- a main body coupled to the hoisting assembly by a second joint, wherein the hoisting assembly is configured to support the main body, and the main body is configured to support a tubular;
- a frame coupled to the main body; and
- a counter moment system configured to apply a force on the first joint to create a bending moment about the second joint, wherein the counter moment system comprises:
  - a bracket coupled to the frame;
  - a hydraulic cylinder coupled to the bracket; and
  - a cable coupled to the hydraulic cylinder and the first joint, wherein the cable is routed through a pulley coupled to the bracket.

2. The system of claim 1, wherein the hydraulic cylinder is configured to create a constant force acting on the cable.

3. The system of claim 1, comprising a controlled pressure circuit configured to regulate operation of the hydraulic cylinder.

4. The system of claim 1, wherein the counter moment system comprises a spring system configured to apply a substantially constant force to the first joint.

5. The system of claim 1, wherein the bending moment is configured to reduce a reactive moment acting on a torque bushing of a torque track system.

6. A top drive system, comprising:
- a hoisting assembly;
- a main body coupled to the hoisting assembly by a first joint, wherein the hoisting assembly is configured to support the main body, and the main body is configured to support a tubular;
- a frame coupled to the main body;

a torque track system comprising a torque bushing; and a counter moment system configured to apply a force on a second joint of the hoisting assembly to create a bending moment about the second joint, wherein the counter moment system comprises:

a bracket coupled to the frame;

a hydraulic cylinder coupled to the bracket; and a cable coupled to the hydraulic cylinder and the second joint, wherein the cable is routed through a pulley coupled to the bracket.

7. The system of claim 6, wherein the bending moment is approximately equal and opposite to an overturning moment acting on the top drive system.

8. The system of claim 7, wherein the overturning moment is created by a center of gravity of the top drive system, and the center of gravity is offset from an axis of a hanging load of the tubular.

9. The system of claim 7, wherein the bending moment is configured to reduce a reactive moment acting on the torque bushing, wherein the reactive moment is reactive to the overturning moment.

10. The system of claim 6, wherein operation of the hydraulic cylinder is regulated by a controlled pressure circuit.

11. The system of claim 6, wherein the force is substantially constant.

12. The system of claim 6, wherein application of the force rotates a link of the hoisting assembly over a center of gravity of the top drive system.

13. A method, comprising:

coupling a main body of a top drive system to a hoisting assembly with a first joint;

suspending the main body of the top drive system with the hoisting assembly; and applying a force to a second joint of the hoisting assembly to create a bending moment about the first joint, wherein applying the force to the second joint of the hoisting assembly comprises coupling a cable to the second joint and to a hydraulic cylinder and compressing the hydraulic cylinder.

14. The method of claim 13, comprising coupling a tubular to the main body of the top drive system and suspending the tubular with the main body of the top drive system.

15. The method of claim 13, wherein the force is substantially constant.

16. The method of claim 13, wherein the bending moment is substantially equal and opposite to an overturning moment acting on the top drive system, wherein the overturning moment is created by a center of gravity of the top drive system, and the center of gravity is offset from an axis of a hanging load of the top drive system.

* * * * *